US006292639B1

(12) United States Patent
Inoue et al.

(10) Patent No.: US 6,292,639 B1
(45) Date of Patent: Sep. 18, 2001

(54) CONTACT CHARGING DEVICE, PROCESS CARTRIDGE AND IMAGE FORMING DEVICE HAVING THE SAME

(75) Inventors: Atsushi Inoue, Nara; Hiroshi Ishii, Osaka, both of (JP)

(73) Assignee: Sharp Kabushiki Kaisha, Osaka (JP)

( * ) Notice: Subject to any disclaimer, the term of this patent is extended or adjusted under 35 U.S.C. 154(b) by 0 days.

(21) Appl. No.: 09/621,960

(22) Filed: Jul. 21, 2000

(30) Foreign Application Priority Data

Jul. 21, 1999 (JP) ..... 11-206804

(51) Int. Cl.[7] ..... G03G 15/02
(52) U.S. Cl. ..... 399/174
(58) Field of Search ..... 399/174, 176, 399/159, 50, 66, 313, 314; 361/225

(56) References Cited

U.S. PATENT DOCUMENTS 5,272,506 * 12/1993 Goto et al. ..... 399/176
5,463,450 * 10/1995 Inoue et al. ..... 399/174
5,548,380 * 8/1996 Naka et al. ..... 399/176
6,035,162 * 3/2000 Chigono ..... 399/175

FOREIGN PATENT DOCUMENTS 03-100675 * 4/1991 (JP) .
5142922A 6/1993 (JP) .
5142923A 6/1993 (JP) .

* cited by examiner

*Primary Examiner*—Robert Beatty

(57) ABSTRACT

A contact charging device includes a charging roller and a power source, the charging roller having a conductive core, a conductive elastic layer and a coating layer and rotating as being in contact with a photoreceptor drum made up of a conductive body and a photoconductor, and the power source applying between the core and the body a bias voltage in which an ac voltage has been superimposed on a dc voltage. The charging roller and the photoreceptor drum form an oscillation system of a characteristic frequency fm which oscillates due to static adsorptive force. The characteristic frequency fm is calculated from each parameter of the oscillation system, and a frequency fac of a superimposed ac voltage or twice the value of the frequency fac is set to fall within a range of fac≦0.5 fm or fac≧1.5 fm so as to suppress both resonance of the oscillation system and relatively large oscillation when taking viscosity damping resistance into consideration. A highly reliable contact charging device capable of surely preventing charging noise can be provided by adopting the highly universal condition of suppressing oscillation as obtained by an efficient method.

22 Claims, 6 Drawing Sheets

CONTACT CHARGING DEVICE, PROCESS CARTRIDGE AND IMAGE FORMING DEVICE HAVING THE SAME

FIELD OF THE INVENTION

The present invention relates to a contact charging device used as a dielectric layer charger, and in particular to a charging noise control thereof.

BACKGROUND OF THE INVENTION

Image forming process by means of an electrophotographic image forming device is made up of a series of processes such as charging, exposure, development, image transfer, cleaning, fixing and static elimination. An example of arrangement of the image forming device is shown in FIG. 6. As shown in the FIG. 6, a photoreceptor drum 3 is rotatably provided in a direction of arrow Si. The photoreceptor drum 3 is made up of a conductive body 3*a* made of metal or resin, and a photoconductor 3*b* having at least an under coating layer and a photosensitive layer being stacked on the body 3*a* in this order. The photosensitive layer, in particular, is made up of a relatively thin Carrier Generation Layer (hereinafter referred to as CGL) which is formed on the under coating layer, and a relatively thin Carrier Transport Layer (hereinafter referred to as CTL), which is the outermost layer made of polycarbonate as a main component.

A main charging device 21, which is made up of a power source 22 and a charger 23 such as a corona charger or a contact-type charging roller, supplies charge on a surface of the photoconductor 3*b* to a predetermined potential. Next, when an exposure device 31 exposes a predetermined portion on the surface of the photoconductor 3*b*, among charges (carriers) generated from the CGL, charges having the opposite polarity to the charge on the surface of the photoconductor 3*b* are moved to the surface of the photoconductor 3*b* through the CTL. This cancels the charge on the surface of the photoconductor 3*b* in the exposed portion and forms an electrostatic latent image potential, thus carrying an electrostatic latent image on the photoconductor 3*b*.

Next, by a rotation of the photoreceptor drum 3, the photoconductor 3*b* carrying the electrostatic latent image moves to a development region D where the photoconductor 3*b* contacts a developing device 41. In the development region D, a developer carrier 42, which rotates in a direction of arrow S2 opposite to the direction of arrow S1, and to which a predetermined bias voltage from a power source (not shown) is applied, is pressed against the surface of the photoconductor 3*b*. Then, toner carried by the developer carrier 42 is transferred from a developer tank 43, and adheres to the electrostatic latent image on the photoconductor 3*b*, thereby visualizing and developing the electrostatic latent image.

After development, the photoconductor 3*b* to which the toner adheres is moved to a transfer region by the rotation of the photoreceptor drum 3. In the transfer region, a transfer device 51 including a high-voltage power source 52 and a charger-type or contact-roller-type transfer charger 53 is provided, and by a paper feeder (not shown), a transfer material P such as paper is transported between the transfer device 51 and the photoconductor 3*b* in synchronism with a transfer timing. By the transfer device 51, a voltage of a polarity which attracts the toner on the photoconductor 3*b* is applied to the transfer material P transported, thereby moving the toner onto the transfer material P and transferring a toner image.

Immediately after the transfer region, a removing device 61 including: a high-voltage power source 62 and a charger-type or contact-roller-type removing charger 63 is provided, by which a voltage of the opposite polarity to the polarity at the time of transfer is applied to the transfer material P sticking to the photoreceptor drum 3 by the charge supplied at the time of transfer. After the transfer material P is removed by the removing device 61 from the photoreceptor drum 3, the toner image on the transfer material P is fixed by a fixing device 71, for example, by thermal fusion. Finished with fixing, the transfer material P is discharged out of the image forming device. In addition, the surface of the photoconductor 3*b* after transfer is cleaned by a cleaning device 81, and residual charges on the surface are eliminated by a static eliminator 91 such as an optical or contact static eliminator so as to electrically initialize the surface.

With regard to the foregoing image forming processes, the contact-type charging roller is frequently used for the main charging device 21 for charging the photoconductor 3*b*. The charging roller has a structure in which its center is a metallic core, and surrounding the metallic core is a conductive elastic roller. In order to charge the surface of the photoconductor 3*b*, the bias voltage is applied between the core of the charging roller and the conductive body 3*a* of the photoreceptor drum 3, and the elastic roller is rotated while keeping contact with the surface of the photoreceptor drum 3. A method of applying only a direct current voltage (hereinafter referred to as dc voltage) as the bias voltage is prone to troubles such as non-uniformity of charging and dirt, and also has a bad influence on the environment. Therefore, a method of superimposing an alternating current voltage (hereinafter referred to as ac voltage) on the dc voltage is pursued.

There is a problem, however, in the foregoing method of applying the bias voltage of a superimposed ac voltage, i.e. as a frequency produced by the ac voltage increases, oscillation of surrounding components such as the photoreceptor drum 3 produces a noise. When the ac voltage is applied to the charging roller, attraction due to electrostatic force between the photoreceptor drum 3 and the charging roller changes over time and acts to generate oscillation. More specifically, as the ac voltage approaches a peak (either the maximum peak or the minimum peak), attraction force (electrostatic force) increases and the elastic roller is drawn to the photoreceptor drum by undergoing elastic deformation, whereas the attraction force decreases as the ac voltage approaches the median of the peaks, which causes the elastic roller to separate from the photoreceptor drum 3 by the restoring force of the elastic roller which has undergone elastic deformation. As a result, an oscillation phenomenon is observed between the photoreceptor drum 3 and the charging roller, thereby producing a charging noise.

For the purpose of preventing the oscillation, Japanese Unexamined Patent Publication No. 142922/1993 (Tokukaihei 5-142922 published on Jun. 11, 1993) discloses a method of increasing a characteristic frequency of the photoreceptor drum by providing a coil spring as a damper in the photoreceptor drum; and Japanese Unexamined Patent Publication No. 142923/1993 (Tokukaihei 5-142923 published on Jun. 11, 1993) discloses a method of increasing the characteristic frequency of the photoreceptor drum by inserting an elastic member in the photoreceptor drum. However, it is required in these two methods to determine by experiment every condition of the member provided in the photoreceptor drum in order to suppress oscillation and thus the methods are inefficient and also non-universal in respect of conditions of suppressing oscillation. Moreover, further troubles may arise over (i) increased number of members and longer assembling time due to insertion of the members into the photoreceptor drum, (ii) poor handling of the photoreceptor drum due to increased weight, and (iii) defective damping effect due to improper mechanical fixing when the members are engaged.

SUMMARY OF THE INVENTION

It is an object of the present invention to provide a highly reliable contact charging device which surely prevents charging noise by applying highly universal conditions for suppressing oscillation as determined by an efficient method.

In order to attain the foregoing object, a contact charging device according to the present invention includes: (i) a conductive charging member which is in contact with a dielectric layer of a charged member which includes a conductive body on which the dielectric layer is formed, and (ii) a power source for applying a bias voltage between the body and the charging member, the bias voltage being a superimposed voltage of an ac voltage on a dc voltage, and the contact charging device employs a highly universal condition of suppressing oscillation, in which the ac voltage has a frequency of a value or a value twice the value of the frequency, which is not more than 0.5 times or not less than 1.5 times a characteristic frequency of an oscillation system which is composed of the charged member and the charging member.

In case of superimposing an ac voltage which is sufficiently small that the polarity of the bias voltage does not reverse, the oscillation system resonates when the ac voltage of a frequency which coincides with the characteristic frequency of the oscillation system made up of the charged member and the charging member is applied between the body and the charging member. Further, in case of superimposing a large ac voltage which reverses the polarity of the bias voltage, the oscillation system resonates when the ac voltage of a frequency which coincides with twice the value of the characteristic frequency is applied between the body and the charging member. Furthermore, taking viscosity damping resistance into consideration, it is found that oscillation having a relatively large amplitude is generated also in a frequency ranging from 0.5 fm to 1.5 fm or from 0.5×2 fm to 1.5×2 fm, where fm is the characteristic frequency.

In the foregoing invention, specifying a frequency of the superimposed ac voltage of the bias voltage or a frequency twice the value of this frequency in a range of not more than 0.5 fm or not less than 1.5 fm, or not more than 0.5×2 fm or not less than 1.5×2 fm, where fm is the characteristic frequency, it is possible to prevent charging noise from being generated, by sufficiently suppressing growth of oscillation in the oscillation system. Consequently, the condition of suppressing oscillation as obtained from the efficient method of specifying the frequency of the superimposed ac voltage becomes highly universal, making it possible for the contact charging device employing this condition to surely prevent charging noise, thereby improving reliability.

Additional objects, features, and strengths of the present invention will be made clear by the description below. Further, the advantages of the present invention will be evident from the following explanation in reference to the drawings.

BRIEF DESCRIPTION OF THE DRAWINGS

FIG. 2(*b*) is a magnified view of a photoconductor where the charging roller and the photoreceptor drum are connected to each other.

DESCRIPTION OF THE EMBODIMENTS

The following will explain one embodiment of the present invention with reference to FIGS. 1 through 5.

Figure 1:
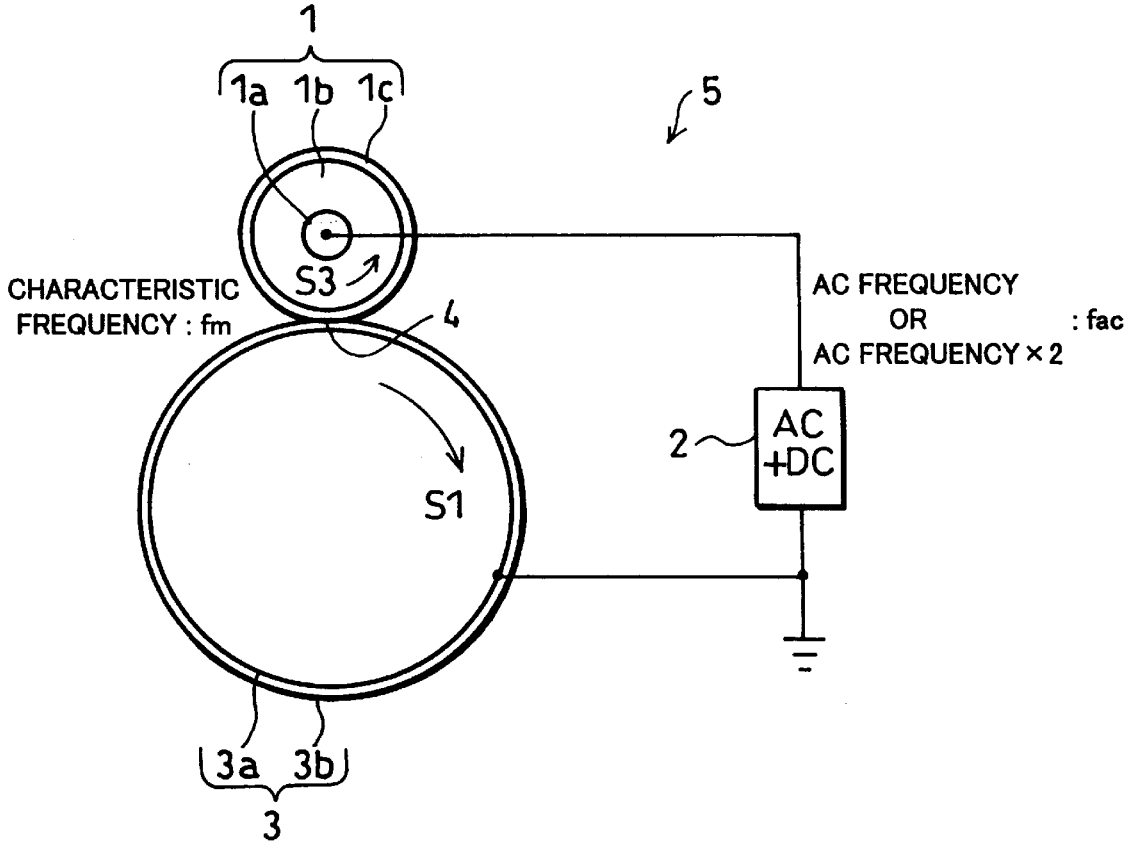
FIG. 1 is a cross section showing a structure of a contact charging device according to one embodiment of the present invention and a contact state thereof with a photoreceptor drum.

A structure of a contact charging device 5 according to the present embodiment, and a contact state thereof with a photoreceptor drum 3 are shown in FIG. 1. As illustrated, the contact charging device 5 as a main charger used for an electrophotographic image forming device is made up of a charging roller 1 and a power source 2. The charging roller (charging member) 1 is arranged in such a manner that the center thereof is a conductive core 1*a* made of stainless steel, outer surface of which is covered with a conductive elastic layer 1*b* made of a material such as urethane or EPDM which is one kind of ethylene propylene rubber, around which is formed a coating layer 1*c* such as of nylon. The power source 2 outputs a bias voltage in which the ac voltage is superimposed on the dc voltage, and applies the bias voltage between the core 1*a* of the charging roller 1 and a body 3*a* of the photoreceptor drum 3. The photoreceptor drum (charged member) 3 is arranged such that a photoconductor (dielectric layer) 3*b* having an OPC photosensitive layer is formed on an outer surface of the conductive body 3*a* which is made of aluminum of a cylindrical shape with a thickness of 1 mm. The body 3*a* is grounded, and the OPC photosensitive layer has a charging characteristic of a negative polarity.

The charging roller 1 contacts the photoreceptor drum 3 at a nip portion (point of contact) 4, and when the photoreceptor drum 3 is driven to rotate in the direction of arrow S1, the charging roller 1 rotates in a direction of arrow S3, following the rotation of the photoreceptor drum 3. The surface of the photoconductor 3*b* is charged to a predetermined potential while passing the nip portion 4, by the bias voltage from the power source 2 via the charging roller 1.

Figure 2A:
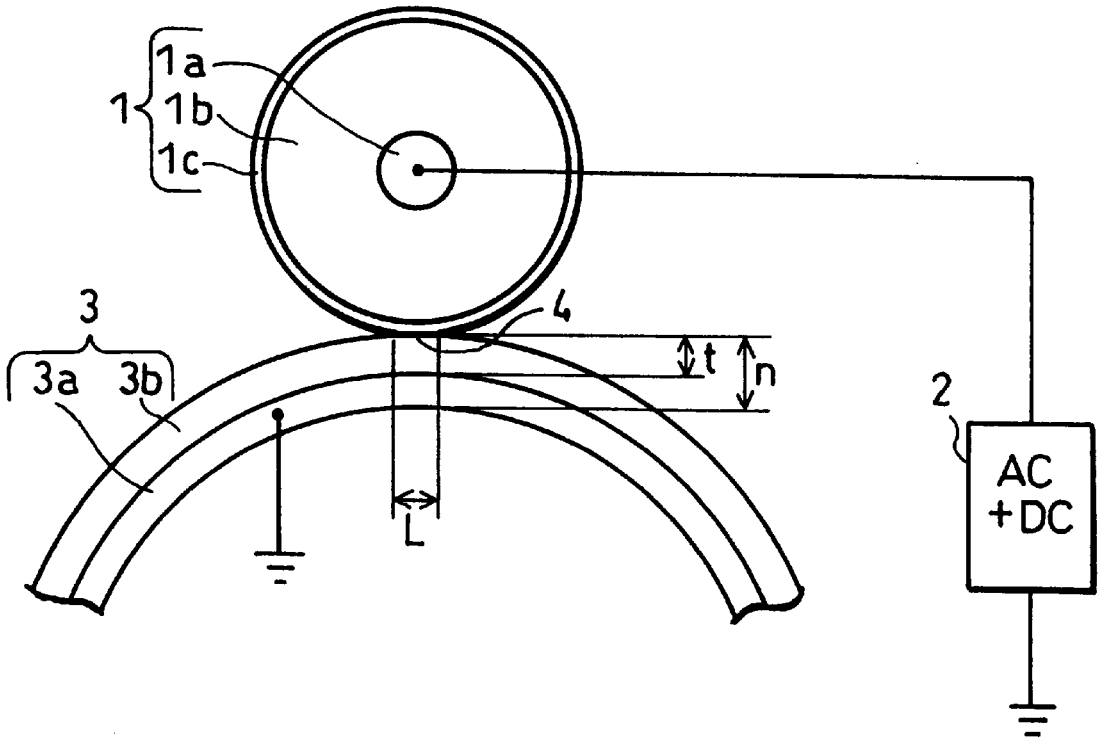
FIG. 2(*a*) is a cross section explaining a state of contact due to static absorptive force which acts between a charging roller and the photoreceptor drum.
Figure 2B:
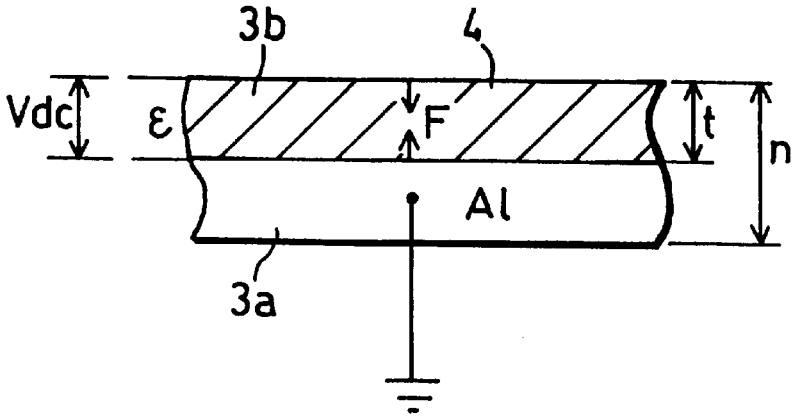

A state of contact between the charging roller 1 and the photoreceptor drum 3 is illustrated in detail in FIG. 2(*a*), and a magnified view of the photoconductor 3*b* at the nip portion 4 is shown in FIG. 2(*b*). As shown in FIG. 2(*a*), the charging roller 1 is deformed at the nip portion 4 due to elasticity of the elastic layer 1*b*, and is in contact with the surface of the photoconductor 3*b*, where L is a nip width in a rotation direction. Considering the case of a dc voltage Vdc of the bias voltage from the power source 2, charge accumulates on the photoconductor 3*b* by the dc voltage Vdc as the photoconductor 3*b* passes the nip portion 4 of the nip width L. Here, if the charge rise time is fast enough with respect to the passing time through the nip portion 4, the voltage applied to the nip portion 4 can be regarded as a constant value of the dc voltage Vdc through the entire nip width L.

Hence, as shown in FIG. 2(*b*), the static adsorptive force acting across the photoconductor 3*b* at the nip portion 4 is given by $$F=\in\cdot Vdc^2/(2t^2) \quad (1)$$

per unit area, where t is a layer thickness of the photoconductor 3*b*, and ∈ a dielectric constant of the photoconductor 3*b*. More specifically, attraction force, which is obtained by multiplying the static adsorptive force F by an area of the nip portion 4, acts between the charging roller 1 and the body 3*a* of the photoreceptor drum 3, and thus, the charging roller 1 and the photoreceptor drum 3 make up an oscillation system. A characteristic frequency fm of the oscillation system is given by $$fm=(\tfrac{1}{2}\pi)(k/W)^{1/2} \quad (2)$$

where W is the weight of the photoreceptor drum 3, while k is a constant equivalent to a spring constant.

Here, in the case where the ac voltage superimposed on the dc voltage is sufficiently small that the polarity of the bias voltage does not reverse over time, i.e. when the direction of an electric field formed is the same all the time, in order to prevent the oscillation system from resonating by the excitation force of the bias voltage, the frequency of the superimposed ac voltage is set so that it does not coincide with the characteristic frequency fm. In addition, when the superimposed ac voltage is large and the electric field formed becomes an alternating electric field, in order to prevent resonance in the oscillation system, the frequency of the superimposed ac voltage is set so that it does not coincide with a value twice the characteristic frequency fm.

The following determines constant k to obtain the characteristic frequency fm. When the nip length in the axis direction of the photoreceptor drum 3 is H, the area of the nip portion 4 is $$A=L\cdot H,$$

and therefore, $$k = A\cdot df/dt \quad (3)$$

$$= -\varepsilon o\cdot\varepsilon s\cdot Vdc^2\cdot t^{-3}\cdot L\cdot H$$

where ∈o is a dielectric constant in vacuum and ∈s is a relative dielectric constant of the photoconductor 3*b*. Additionally, the weight W of the photoreceptor drum 3 is given by $$W=(\pi/4)\{d^2-(d-2n)^2\}\cdot H\cdot\gamma \quad (4)$$

where d is the diameter of the photoreceptor drum 3, n the wall thickness of the photoreceptor drum 3, and γthe density of aluminum.

The following actual values are substituted in the equations (3) and (4) above:

Dielectric constant in vacuum: $\in o=8.855\times10^{12}$ [F/m]

Dc voltage: Vdc=600 [V]

Relative dielectric constant of photoconductor 3*b*: ∈s=3.0

Layer thickness of photoconductor 3*b*: t=20 [μm]

Nip width: L=2 [mm]

Nip length: H=200 [mm]

Diameter of photoreceptor drum 3: d=30 [mm]

Wall thickness of photoreceptor drum 3: n=1 [mm]

Density of aluminum: 2.7 [gr/cm$^3$].

As a result, $$K=(8.855\times10^{-12})\times3.0\times600^2\times(20\times10^{-6})^{-3}\times(2\times10^{-3})\times(200\times10^3)$$

$$\approx4.782\times10^5[N/m]$$

$$W=(\pi/4)(3^2-2.8^2)\cdot20\cdot2.7$$

$$\approx49.19[gr],$$

and therefore, if these values are substituted in the equation (2) above, the results will be $$fm=(1/2\ \pi)\{(4.782\times10^5)/(49.19\times10^{-3})\}^{1/12}$$

$$\approx497.2[Hz].$$

Figure 3:
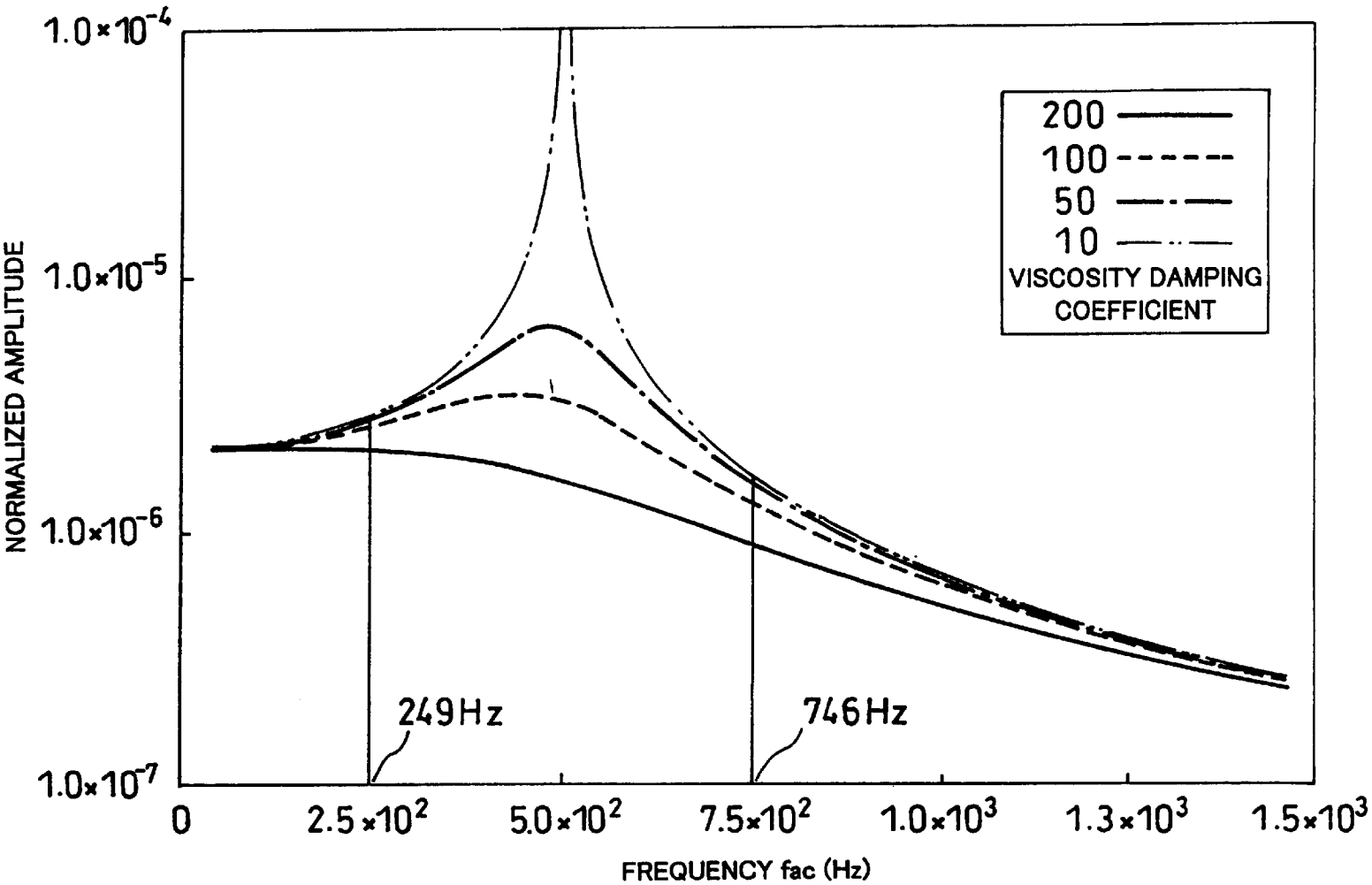
FIG. 3 is a graph showing a relationship between an oscillation amplitude and a frequency of an ac voltage applied from a power source in an oscillation system made up of the charging roller and the photoreceptor drum.
Figure 4:
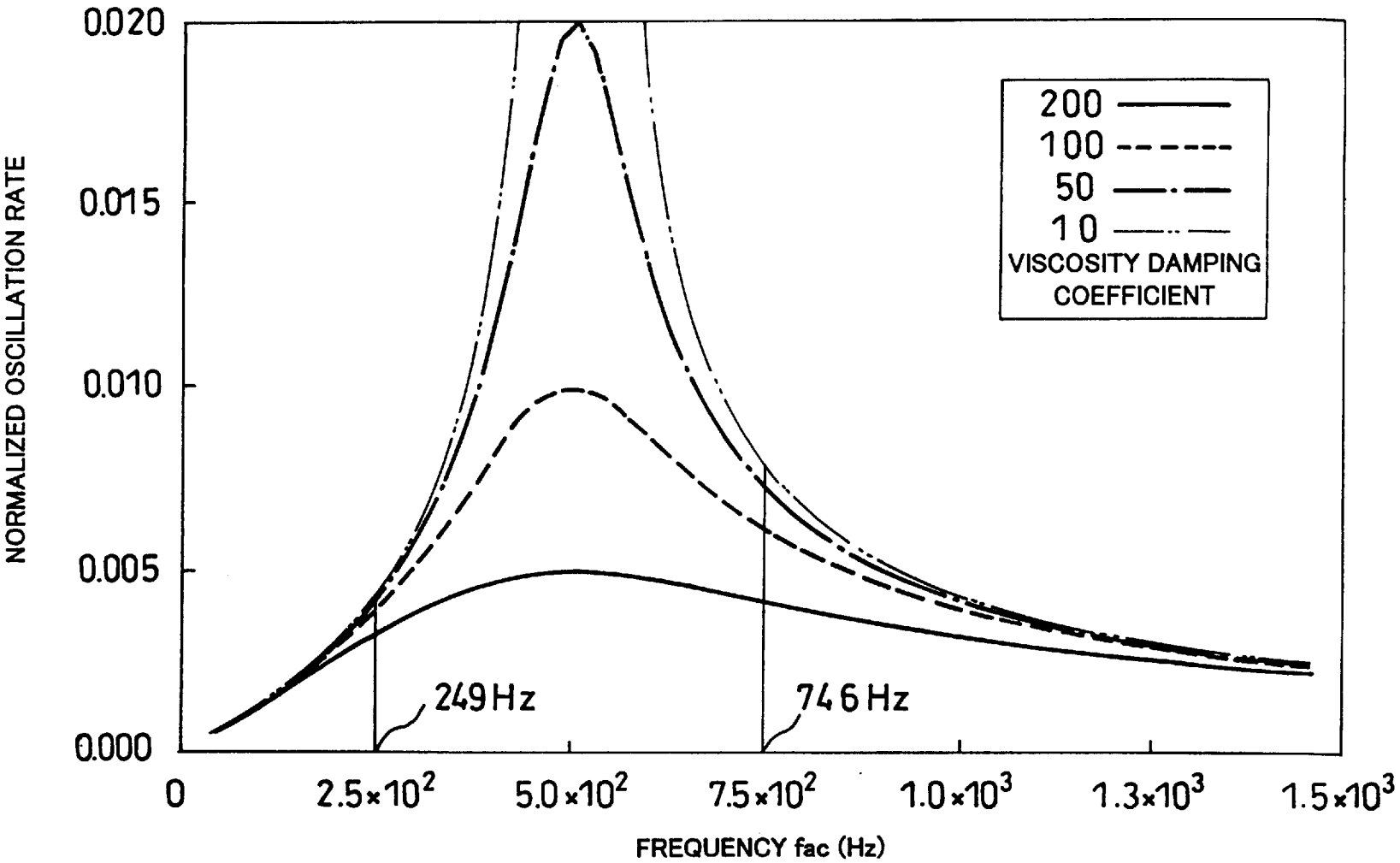
FIG. 4 is a graph showing a relationship between oscillation rate and the frequency of the ac voltage applied from the power source in the oscillation system made up of the charging roller and the photoreceptor drum.

Since viscosity damping resistance adds to the actual oscillation, frequency characteristics of an oscillation amplitude and oscillation rate of the oscillation system with respect to the frequency fac of the superimposed ac voltage were calculated, taking into consideration the viscosity damping coefficient under the condition where the excitation force by the bias voltage continues acting on the oscillation system having the characteristic frequency fm of 497.2 [Hz], and the results of which are indicated in FIGS. 3 and 4. In this case, it is presupposed that the amplitude of the superimposed ac voltage is sufficiently small so that the polarity of the bias voltage does not reverse as time passes, and there are four viscosity damping coefficients, ranging from 10 through 200.

As is clear from FIGS. 3 and 4, when the frequency fac of the superimposed ac voltage falls within a range of 249 [Hz] to 746 [Hz] , which are respectively 0.5 times and 1.5 times the characteristic frequency fm of 497.2 [Hz] at the center of this range, the oscillation increases abruptly as the viscosity damping coefficient becomes smaller. On the other hand, if the frequency fac is in a range of not more than 0.5 fm or not less than 1.5 fm, increase in oscillation is suppressed, regardless of the value of the viscosity damping coefficient.

Consequently, by setting the frequency fac at the condition of suppressing oscillation represented by fac≦0.5 fm or fac≧1.5 fm, it is possible to sufficiently suppress increase of the oscillation in the oscillation system, thereby preventing generation of charging noise. Further, if the superimposed ac voltage is large and the electric field formed becomes an alternating electric field, an equivalent effect to the above can be obtained by multiplying the frequency fac of the superimposed ac voltage by two and by setting this frequency fac at fac≦0.5 fm or fac≧1.5 fm.

Since the condition of suppressing oscillation is thus determined by the efficient method of specifying a range of the frequency fac of the superimposed ac voltage, only a calculation is required even when using a different contact charging device and a different photoreceptor drum. Consequently, the condition of suppressing oscillation becomes more universal, and the contact charging device 5 employing this condition can surely prevent generation of charging noise, thereby improving reliability. In addition, by thus suppressing the oscillation, addition of new components is not particularly required, thereby avoiding complication of the device and reducing assembly time of the device.

Figure 5:
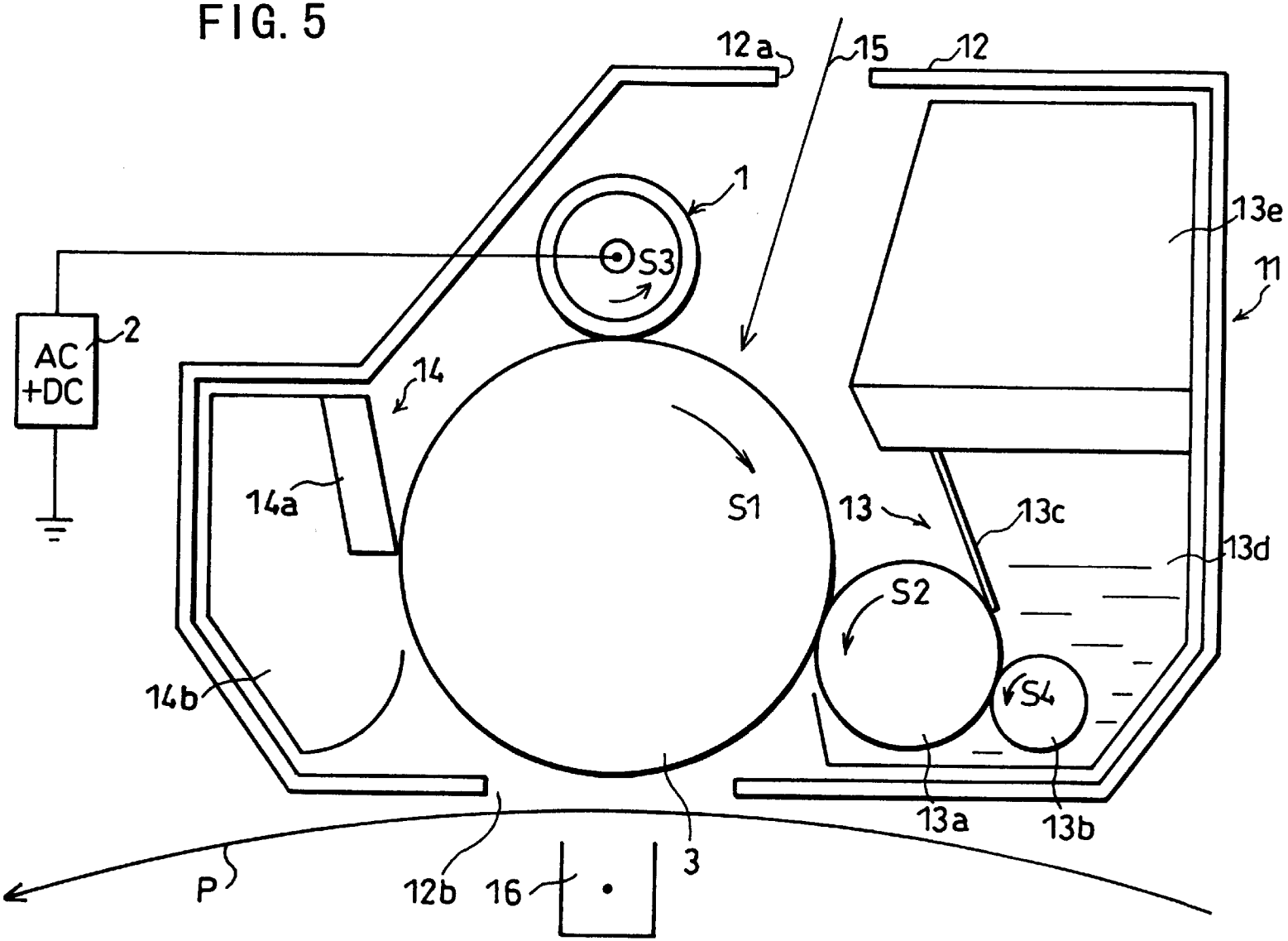
FIG. 5 is a cross section showing a structure of a process cartridge in which the contact charging device of FIG. 1 is adopted.

Next, FIG. 5 shows a cross section of an image forming device in which a part of the contact charging device 5 employing the condition of suppressing oscillation is housed in a process cartridge for use in an electrophotographic image forming process. A process cartridge 11 shown in FIG. 5 is made up of a cartridge case 12, a charging roller 1, a photoreceptor drum 3, a developing device 13 and a cleaning device 14. In this case, a power source 2 of the contact charging device 5, which supplies power to the charging roller 1, is provided outside of the process cartridge 11.

The cartridge case 12 includes an opening 12*a* through which exposure light from an external exposure device 15 passes, and an opening 12*b* for securing a transfer region between the photoreceptor drum 3 and an external transfer device 16. The openings 12*a* and 12*b* each has a predetermined width as shown in FIG. 5, and a length the same as, or longer than, that of the axis of the photoreceptor drum 3 in a direction perpendicular to the plane of the paper. The exposure device 15 and the transfer device 16 have functions equivalent to those of an exposure device 31 and a transfer device 51 shown in FIG. 6, respectively.

Figure 6:
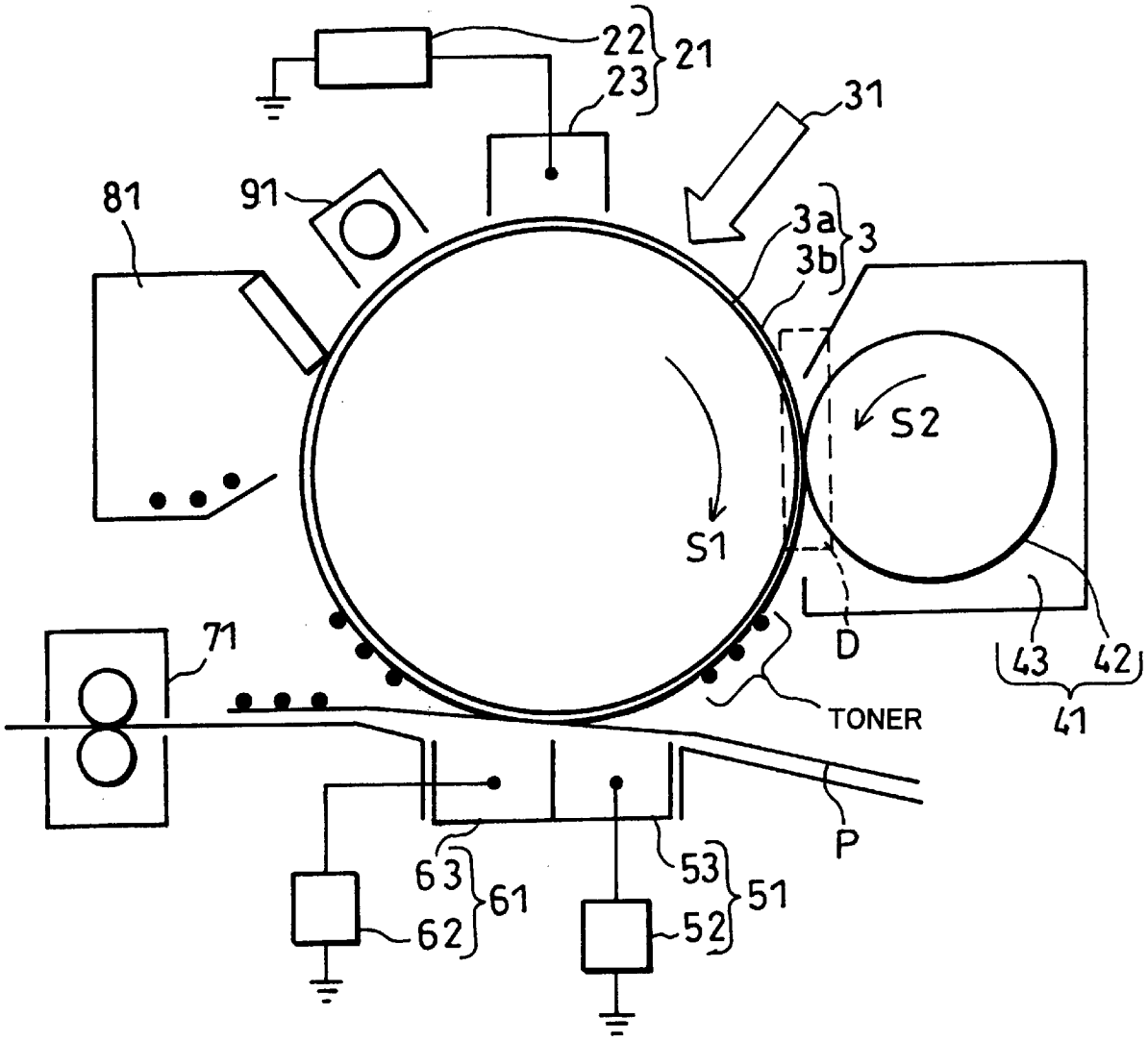
FIG. 6 (PRIOR ART)
FIG. 6 is a cross section showing a structure of an image forming device in which a conventional contact charging device is adopted.

The developing device 13 and the cleaning device 14, respectively, have functions equivalent to those of a developing device 41 and a cleaning device 81 shown in FIG. 6. The developing device 13 includes, in addition to a developing roller 13*a* as a developer carrier, an agitation transport roller 13*b* for supplying the developing roller 13*a* with developer by rotating in a direction of arrow S4, a layer thickness adjusting blade 13*c* for adjusting layer thickness of the developer supplied by the agitation transport roller 13*b*, a developer tank 13*d* for storing developer, and a toner hopper 13*e* for replenishing toner in the developer tank 13*d*. The cleaning device 14 includes a cleaning blade 14*a* for collecting residual toner through contact with the surface of the photoconductor 3*b*, and a storage room 14*b* for storing the collected residual toner.

Note that, though not illustrated, the process cartridge 11 may include a static eliminator 91 as shown in FIG. 6. Further, when providing a removing device 61 as shown in FIG. 6, the size of the opening 12*b* is adjusted to cover an area where removal of the transfer material P is performed. Since the image forming process by means of an image forming device utilizing the process cartridge 11 arranged as above is the same as in the case of FIG. 6, an explanation thereof is omitted.

In this way, since the contact charging device 5 as a main charger, the photoreceptor drum 3 and the other components are provided in one unit to form the process cartridge 11, assembling and exchanging of parts become easier in a device using the process cartridge 11. Moreover, by detachably providing the process cartridge 11 in conventional electrophotographic image forming devices, it is possible to prevent conventional charging noise by simple replacement of the part.

Furthermore, by using the process cartridge 11, or by adopting the contact charging device 5 as a main charger (though not necessarily formed in a unit), oscillation due to a contact charging device, which conventionally spread over an entire image forming device, can be sufficiently suppressed in image forming devices for performing an electrophotographic image forming process.

Note that, the contact charging device 5 was explained through the case where it was used in an electrophotographic image forming device which employs the photoconductor 3*b*. However, the contact charging device according to the present invention is not just limited to this, and it is equally applicable to any use for charging the dielectric layer in contact.

As discussed, the contact charging device of the present invention includes: a conductive charging member which is in contact with a dielectric layer of a charged member which includes a conductive body on which the dielectric layer is formed, and a power source for applying a bias voltage between the body and the charging member, the bias voltage being a superimposed voltage of an ac voltage on a dc voltage, in which the ac voltage has a frequency of a value or a value twice the value of the frequency, which is not more than 0.5 times or not less than 1.5 times a characteristic frequency of an oscillation system which is composed of the charged member and the charging member.

In case of superimposing the ac voltage which is sufficiently small that the polarity of the bias voltage does not reverse, the oscillation system resonates when the ac voltage of the frequency which coincides with the characteristic frequency of the oscillation system made up of the charged member and the charging member is applied between the body and the charging member. Further, in case of superimposing a large ac voltage which reverses the polarity of the bias voltage, the oscillation system resonates when the ac voltage of the frequency which coincides with twice the value of the characteristic frequency is applied between the body and the charging member. Furthermore, taking the viscosity damping resistance into consideration, it is found that oscillation having a relatively large amplitude is generated also in the frequency ranging from 0.5 fm to 1.5 fm or from 0.5×2 fm to 1.5×2 fm, where fm is the characteristic frequency.

Specifying the frequency fac of the superimposed ac voltage of the bias voltage or the frequency twice the value of this frequency in a range of not more than 0.5 fm or not less than 1.5 fm, or not more than 0.5×2 fm or not less than 1.5×2 fm, it is possible to prevent charging noise from being generated, by sufficiently suppressing growth of oscillation in the oscillation system. Consequently, the condition of suppressing oscillation as obtained from the efficient method of specifying the frequency of the superimposed ac voltage becomes highly universal, making it possible for the contact charging device employing this condition to surely prevent charging noise, thereby improving reliability.

Further, when $fm=(1/2\pi)\ (k/W)^{1/2}$, and $k=\in o\cdot\in s\cdot Vdc^2\cdot t^{-3}\cdot A$, where fm is the characteristic frequency, $\in o$ the dielectric constant in vacuum, $\in s$ the relative dielectric constant of the dielectric layer, t the layer thickness of the dielectric layer, Vdc the dc voltage, W the weight of the charged member, and A the area of the contact portion between the dielectric layer and the charging member, it is preferable in the contact charging device that $$fac \leqq 0.5\ fm \text{ or } fac \geqq 1.5\ fm,$$

where fac is either the frequency of the ac voltage or the frequency twice the value of this frequency.

The condition of suppressing oscillation can be obtained simply by specifying a relationship between the characteristic frequency obtained from the above equation and either one of the frequency of the superimposed ac voltage and twice the value of this frequency, within the predetermined range as shown above, thereby readily realizing the contact charging device employing the highly universal condition of suppressing oscillation as obtained by the efficient method.

Further, it is preferable in the contact charging device of the present invention that the dielectric layer is the photoconductor used for the photoreceptor drum which is rotatably driven, and the charging member is the charging roller which contacts the photoreceptor drum by rotation.

Consequently, generation of charging noise can surely be prevented in the contact charging device as a main charger for initially charging the photoconductor in the electrophotographic image forming device.

Further, it is preferable that the process cartridge of the present invention includes in one unit the contact charging device and the photoreceptor drum, and predetermined components used in an electrophotographic image forming process.

By having the process cartridge in one unit composed of the contact charging device as the main charger, the photoreceptor drum and the other components, it becomes easier to assemble and/or replace parts in a device using the process cartridge. Moreover, by detachably providing the process cartridge in conventional electrophotographic image forming devices, it becomes possible to prevent conventional charging noise by simple replacement of the part.

Furthermore, it is preferable that the image forming device of the present invention includes either the contact charging device or the process cartridge, for use in the electrophotographic image forming process.

Consequently, oscillation due to a contact charging device which conventionally spread over an entire image forming device can sufficiently be suppressed in the image forming device for performing the electro-photographic image forming process, by adopting the foregoing contact charging device as a main charger or by providing this contact charging device in the process cartridge.

The embodiments and concrete examples of implementation discussed in the foregoing detailed explanation serve solely to illustrate the technical details of the present invention, which should not be narrowly interpreted within the limits of such embodiments and concrete examples, but rather may be applied in many variations within the spirit of the present invention, provided such variations do not exceed the scope of the patent claims set forth below.

What is claimed is:

1. A contact charging device, comprising:

a conductive charging member which is in contact with a dielectric layer of a charged member which includes a conductive body on which said dielectric layer is formed; and a power source for applying a bias voltage between said body and said charging member, the bias voltage being superimposed voltage of an ac voltage on a dc voltage, the ac voltage having a frequency of a value when the direction of an electric field formed between a charged member and a charging member is always the same, or a value twice the value of the frequency when said electric field becomes an alternating electric field, which is not more than 0.5 times or not less than 1.5 times a characteristic frequency of an oscillation system which is composed of said charged member and said charging member.

2. The contact charging device as set forth in claim 1, wherein:

said dielectric layer is a photoconductor used for a photoreceptor drum which is rotatably driven, and said charging member is a charging roller which contacts said photoreceptor drum by rotation.

3. The contact charging device as set forth in claim 2, wherein:

said charging roller includes a conductive core connected to said power source, a conductive elastic layer covering an outer surface of said core, and a coating layer formed on the conductive elastic layer.

4. The contact charging device as set forth in claim 1, wherein:

when $$fm=(\tfrac{1}{2}\pi)(k/W)^{1/2}$$

$$k=\in o\cdot\in\cdot Vdc^2 s\cdot t^{-3}\cdot A,$$

where fm is the characteristic frequency, $\in o$ a dielectric constant in vacuum, $\in s$ a relative dielectric constant of said dielectric layer, t a layer thickness of said dielectric layer, Vdc said dc voltage, W weight of said charged member, and A an area of a contact portion between said dielectric layer and said charging member, $$fac \leqq 0.5\ fm \text{ or } fac \geqq 1.5\ fm,$$

where fac is a frequency of a value when the direction of an electric field formed between a charged member and a charging member is always the same, or a value twice the value of the frequency when said electric field becomes an alternating electric field of said ac voltage.

5. The contact charging device as set forth in claim 4, wherein:

said dielectric layer is a photoconductor used for a photoreceptor drum which is rotatably driven, and said charging member is a charging roller which contacts said photoreceptor drum by rotation.

6. The contact charging device as set forth in claim 5, wherein:

said charging roller includes a conductive core connected to said power source, a conductive elastic layer covering an outer surface of said core, and a coating layer formed on the conductive elastic layer.

7. A process cartridge unit, comprising:

a photoreceptor drum made up of a dielectric layer formed on a conductive layer;

a contact charging device having a dielectric charging roller which contacts said photoreceptor drum by rotation, said contact charging device applying a bias voltage between said body and said charging roller, the bias voltage being a superimposed voltage of an ac voltage on a dc voltage, the ac voltage having a frequency of a value when the direction of an electric field formed between a charged member and a charging member is always the same, or a value twice the value of the frequency when said electric field becomes an alternating electric field, which is not more than 0.5 times or not less than 1.5 times a characteristic frequency of an oscillation system which is composed of said charged member and said charging roller; and a predetermined component use in an electrophotographic image forming process.

8. The process cartridge unit as set forth in claim 7, comprising:

a developing device which forms a toner image by said component which develops an electrostatic latent image formed on said photoreceptor drum; and a cleaning device for collecting residual toner on said photoreceptor drum after said toner image is transferred onto a transfer material.

9. The process cartridge unit as set forth in claim 8, wherein:

said component further includes a static eliminator for eliminating residual charge on a surface of said photoreceptor drum after said cleaning device has collected the toner.

10. The process cartridge unit as set forth in claim 7, wherein:

when $$fm=(\tfrac{1}{2}\pi)(K/W)^{1/2}$$

$$k=\in o\cdot\in s\cdot Vdc^2\cdot t^{-3}\cdot A,$$

where fm is the characteristic frequency, ∈o a dielectric constant in vacuum, ∈s a relative dielectric constant of said dielectric layer, t a layer thickness of said dielectric layer, Vdc said dc voltage, W weight of said charged member, and A an area of a contact portion between said dielectric layer and said charging member, $$fac\leqq 0.5\ fm \text{ or } fac\geqq 1.5\ fm,$$

where fac is a frequency of a value when the direction of an electric field formed between a charged member and a charging member is always the same, or a value twice the value of the frequency when said electric field becomes an alternating electric field of said ac voltage.

11. The process cartridge unit as set forth in claim 10, comprising:

a developing device which forms a toner image by said component which develops an electrostatic latent image formed on said photoreceptor drum; and a cleaning device for collecting residual toner on said photoreceptor drum after said toner image is transferred onto a transfer material.

12. The process cartridge unit as set forth in claim 11, wherein:

said component further includes a static eliminator for eliminating residual charge on a surface of said photoreceptor drum after said cleaning device has collected the toner.

13. An image forming device includes a contact charging device used in an electrophotographic image forming process, comprising:

a charging roller being a conductive charging member which is in contact with a dielectric layer of a charged member which includes a conductive body on which said dielectric layer is formed; and a power source for applying a bias voltage between said body and said charging member, the bias voltage being a superimposed voltage of an ac voltage on a dc voltage, the ac voltage having a frequency of a value when the direction of an electric field formed between a charged member and a charging member is always the same, or a value twice the value of the frequency when said electric field becomes an alternating electric field, which is not more than 0.5 times or not less than 1.5 times a characteristic frequency of an oscillation system which is composed of said charged member and said charging member.

14. The image forming device as set forth in claim 13, wherein:

said charging roller includes a conductive core connected to said power source, a conductive elastic layer covering an outer surface of said core, and a coating layer formed on the conductive elastic layer.

15. The image forming device as set forth in claim 13, wherein:

when $$fm=(\tfrac{1}{2}\pi)(k/W)^{1/2}$$

$$k=\in o\cdot\in s\cdot Vdc^2\cdot t^{-3}\cdot A,$$

where fm is the characteristic frequency, ∈o a dielectric constant in vacuum, ∈s a relative dielectric constant of said dielectric layer, t a layer thickness of said dielectric layer, Vdc said dc voltage, W weight of said charged member, and A an area of a contact portion between said dielectric layer and said charging member, $$fac\leqq 0.5\ fm \text{ or } fac\geqq 1.5\ fm,$$

where fac is a frequency of a value when the direction of an electric field formed between a charged member and a charging member is always the same, or a value twice the value of the frequency when said electric field becomes an alternating electric field of said ac voltage.

16. The image forming device as set forth in claim 15, wherein:

said charging roller includes a conductive core connected to said power source, a conductive elastic layer covering an outer surface of said core, and a coating layer formed on the conductive elastic layer.

17. An image forming device which includes a process cartridge unit used in an electrophotographic image forming process, the image forming device comprising:

a contact charging device which includes a photoreceptor drum made up of a dielectric layer formed on a conductive body, and a conductive charging roller for contacting said photoreceptor drum by rotation, said contact charging device applying a bias voltage between said body and said charging roller, the bias voltage being a superimposed voltage of an ac voltage on a dc voltage, the ac voltage having a frequency of a value when the direction of an electric field formed between a charged member and a charging member is always the same, or a value twice the value of the frequency when said electric field becomes an alternating electric field, which is not more than 0.5 times or not less than 1.5 times a characteristic frequency of an oscillation system which is composed of said charged member and said charging roller; and a predetermined component use in an electrophotographic image forming process.

18. The image forming device as set forth in claim 17, comprising:

a developing device which forms a toner image by said component which develops an electrostatic latent image formed on said photoreceptor drum; and a cleaning device for collecting residual toner on said photoreceptor drum after said toner image is transferred onto a transfer material.

19. The image forming device as set forth in claim 18, wherein:

said component further includes a static eliminator for eliminating residual charge on a surface of said photoreceptor drum after said cleaning device has collected the toner.

20. The image forming device as set forth in claim 17, wherein:

when $$fm=(\tfrac{1}{2}\pi)(k/W)^{1/2}$$

$$k=\in o\cdot\in s\cdot Vdc^2\cdot t^{-3}\cdot A,$$

where fm is the characteristic frequency, $\in o$ a dielectric constant in vacuum, $\in s$ a relative dielectric constant of said dielectric layer, t a layer thickness of said dielectric layer, Vdc said dc voltage, W weight of said charged member, and A an area of a contact portion between said dielectric layer and said charging member, $$fac \leqq 0.5\ fm \text{ or } fac \geqq 1.5\ fm,$$

where fac is a frequency of a value when the direction of an electric field formed between a charged member and a charging member is always the same, or a value twice the value of the frequency when said electric field becomes an alternating electric field of said ac voltage.

21. The image forming device as set forth in claim 20, comprising:

a developing device which forms a toner image by said component which develops an electrostatic latent image formed on said photoreceptor drum; and a cleaning device for collecting residual toner on said photoreceptor drum after said toner image is transferred onto a transfer material.

22. The image forming device as set forth in claim 21, wherein:

said component further includes a static eliminator for eliminating residual charge on a surface of said photoreceptor drum after said cleaning device has collected the toner.

* * * * *